United States Patent [19]

Schott

[11] 4,090,382

[45] May 23, 1978

[54] EXPANDING AND BEADING APPARATUS FOR TUBES AND THE LIKE

[75] Inventor: Donald E. Schott, Chester, Vt.

[73] Assignee: Thomas C. Wilson, Inc., Long Island City, N.Y.

[21] Appl. No.: 764,295

[22] Filed: Jan. 31, 1977

[51] Int. Cl.[2] ..... B21D 39/06

[52] U.S. Cl. ..... 72/119; 72/123

[58] Field of Search ..... 72/118, 119, 120, 122, 72/123

[56] References Cited

U.S. PATENT DOCUMENTS

| | | | |
|---|---|---|---|
| 355,644 | 1/1887 | Emery | 72/123 |
| 533,662 | 2/1895 | McCormack | 72/119 |
| 941,190 | 11/1909 | Didier | 72/119 |
| 956,334 | 4/1910 | Gallon | 72/123 |
| 1,322,921 | 11/1919 | Maupin | 72/118 |
| 2,070,504 | 2/1937 | Bannerman | 72/119 |

*Primary Examiner*—Lowell A. Larson
*Attorney, Agent, or Firm*—Pennie & Edmonds

[57] ABSTRACT

An apparatus is disclosed for expanding and beading the end portion of a steel tube positioned within an opening of a tube sheet for use in boilers, heat exchangers and the like. The apparatus accomplishes the expansion and beading of the tube with relative portability, substantial efficiency, and minimum noise levels. An elongated housing has one end portion adapted to be inserted into the tube with a plurality of rollers mounted for rotation about the periphery. The rollers are tapered slightly and offset at an acute angle with respect to the central axis of the housing. A mandrel having a taper opposite that of the rollers is positioned therebetween such that insertion of the housing into the tube while rotatably inserting the mandrel between the rollers causes the rollers to roll into the tube along a helical path while shifting radially outward to expand the tube and develop generally axial and substantial inward forces. A beading roll is positioned on the housing and loosely retained so as to engage the end of the tube so as to cold work the end of the tube to provide an arcuate bead in sealed relation with the tube sheet. Substantial forces are transmitted to the beading roll via the housing and these forces are sufficient to deform the end of the steel tube by cold working. The beading roll is capable of transferring these cold working forces to the tube primarily by the provision of two substantial support rollers mounted on roller bearings. An offset bearing member is mounted on the housing to engage and roll along the inner surface of the tube so as to offset bending forces produced by the beading roll on the housing. An alternate embodiment utilizes dual opposed beading rolls while eliminating the offset bearing member.

18 Claims, 15 Drawing Figures

EXPANDING AND BEADING APPARATUS FOR TUBES AND THE LIKE

BACKGROUND OF THE INVENTION

1. Field of the Invention

This invention relates to a tool for expanding and beading the end portions of a tube extending through a tube sheet of a boiler, heat exchanger or the like.

2. Description of the Prior Art

Various devices have been proposed for expanding and beading boiler tubes within tube sheets so as to provide a sealed attachment. Generally the forces required to deform the steel tubing have been so substantial as to prohibit the use of relatively simple or portable tools since the development of such forces have been practically impossible with smaller tools.

My commonly assigned U.S. Pat. No. 3,426,565 relates to a tube expander of the roller and mandrel type which includes a stop collar for restricting movement of the rollers into the tube. U.S. Pat. No. 2,448,512 relates to tube expanding tools which utilize offset tapered rollers for expanding tools, but includes a protective stop collar to limit the outward radial movement of the rollers. U.S. Pat. No. 2,804,119 discloses a relatively complex beading tool which bends back and beads the end of a tube against a tube sheet to secure it in position without expansion of the tube. U.S. Pat. No. 2,526,025 discloses a combination tool having axially offset rollers which are driven radially outwardly by a mandrel for expanding a tube with a pair of rollers 20 provided to bend back the tube end. The rollers 20 are, however, not substantially supported and would not be capable of providing the required metal deforming forces against the end of tube as required for forming the sheets of the type used for boilers. The rollers are mounted in the housing with their rear surfaces in engagement with the wall thereof so that as the tool is rotatably driven into the tube, the rollers are forced against the tube and bend back the end portions of the tube to form the bead. Because these rollers are in metal-to-metal contact over their entire rear surfaces with the wall of the housing, very large rotational frictional forces are produced between the rolls and the housing during the formation of the bead. Hence, this arrangement of the beader rolls greatly increases the power required to rotate the tool since the force applied to the tool must overcome the large frictional forces developed between the beader rolls and the housing in addition to forming the bead. Furthermore, the two beader rolls of the tool shown in the patent are disposed assymmetrically about the axis of the tool so that during the beading operation, bending forces would be produced, tending to cock the tool in the tube. In addition, the patent teaches that the axes of the slots and the expansion rollers should be substantially parallel with the axis of the tubular head. A tool constructed in such a manner must be driven into the tube by power tools or the like, since expansion rollers rotating about axes which are parallel to the axis of the tubular head would not produce traction forces which rotatably drive the tool into the tube. U.S. Pat. No. 3,947,950 to Adams relates to an extremely complex apparatus for beading heat exchange tubes.

Additional attempts have been made to develop expanding and beading devices which could quickly and conveniently expand and substantially simultaneously bead the end portion of a boiler tube in a tube sheet by a single operator without the assistance of heavy duty machinery. However, none of these devices were successful in combining mechanical advantage with high efficiency and portability. I have invented an apparatus which combines such advantageous features while simultaneously avoiding the deficiencies of the prior art.

SUMMARY OF THE INVENTION

The invention relates to an apparatus for expanding and beading an end portion of a tubular member positioned within an opening defined by an outer member such as a tube sheet of the type used in boilers, condensers, heat exchangers, and the like. The invention comprises an elongated housing having one end portion adapted to be inserted into the tubular member, means mounted in the housing for expanding the end portion of the tubular member radially outwardly in engaged relation of peripheral portions of the outer member and for developing forces directed axially into the tubular member. The invention comprises means to engage and deform the end portion of the tubular member so as to form a peripheral bead thereabout when the housing is drawn inwardly by the tubular member by the inwardly directed traction forces and means for rotatably supporting the beading means in a direction generally longitudinally of the housing by reaction forces sufficient to cause the beading means to deform the end portion of the tubular member when the housing is drawn therein.

In a preferred embodiment a single beading means in the form of a beading roll is preferably positioned at an acute angle offset from the central longitudinal axis of the housing and such beading roll is supported against the cold working reaction forces utilized to form a peripheral bead on the tubular member by at least two support rollers, each having a diameter at least equal to, or larger than the diameter of the beading roll. The support rollers are conveniently rotatably mounted on the housing in engagement with the beading roll by bearings preferably of the roller type. Such bearings are capable of supporting radial forces and are sufficient in size to provide reaction forces which support the beading roll against the substantial forces needed to cold work the end portion of the tubular member. It will be understood that where the tubular member is in the form of a boiler tube of steel construction from, say 2 to 3 inches outside diameter and having a wall thickness of, say, 0.095 to 0.125 inch thickness, the forces required to deform the end portion of the tubular member by cold working are quite substantial. Accordingly, these forces are readily provided by the unique bearing mounted supporting rollers.

Inwardly directed traction forces sufficient to deform the end portion of the tubular member are preferably provided by the provision of a plurality of rollers rotatably positioned in slotted portions defined about the periphery of the housing which is provided in the form of concentrically positioned tubular sections defining a cage to support the rollers. The rollers are of a generally tapered configuration and have their axes of rotation at an acute angle offset from the axis of the housing. The slotted portions of the housing are dimensioned such that the tapered rollers are retained therein but movable radially outwardly from an innermost position to an outwardmost position. The rollers are moved to their outwardmost position by the engagement of a tapered mandrel which is positioned centrically therebetween and which has its taper generally opposite the taper of each roller. The combination of the outward movement of the rollers provided by the engagement of the tapered mandrel, and the offset orientation of the rollers as well as their tapered configuration, provided traction forces between the rollers and the inner surface of the tubular member, which draw the housing inwardly of the tubular member when the assembly is rotated. Simultaneously, as the tapered mandrel rotatably engages the rollers and as the rollers move radially outwardly the end portion of the tubular member engaged by the rollers becomes expanded. Thus, when the tubular member is positioned within a circular opening of boiler tube sheet and the mandrel is rotatably driven into the housing, the rollers will traverse a generally helical path into the tubular member while simultaneously moving radially outwardly and expanding the end portion of the tubular member into engagement with the surface of the opening in the sheet. This arrangement has made it possible to develop metal deforming forces with a portable apparatus where machines of substantial size and power were previously used.

It has been found that the traction forces generated in such an arrangement are sufficient to cold work the end portion of the tubular member, particularly when a degreasing solvent is applied to the traction rollers and on the inner surface portions of the tubular member. The solvent is preferably of a substantially degreasing type which has a high flash point (i.e., it does not burn easily), is non-explosive, non-toxic, and of low lubricity. Such a solvent has been found to readily conduct heat generated by the cold working of the tubular member away from the metal forming area.

A feature of the preferred embodiment of the invention resides in the provision of a through hardened small beading roll having a concave groove extending about its periphery, the beading roll being of sufficiently minimum diameter to provide such concentration of forces as to form a peripheral bead by cold working the end portion of the tube member.

With a beading roll of such minimum diameter, the support rollers, which are mounted on shafts affixed to the housing can be made sufficiently large to accommodate bearings of such size positioned between the rollers and their shafts, that they are capable of withstanding the large forces produced during the formation of the bead. Thus, with such dimensional freedom, the bearings of the support rollers may be of such size and capability as to minimize the frictional forces between the support rollers and the beading roll thereby reducing the force required to form the bead. In such arrangement, the beading roll is seated on the housing in a pocket formed by the housing and the support rollers and is retained on the housing by means of a retaining strap extending between the two bearing pins of the support rolls. The retaining strap provides limited freedom for the beading roll within the pocket in a direction parallel to its axis of rotation so that the roll automatically aligns itself with the end of the tube when it comes into engagement therewith. The beading roll, moreover, has a concave cross-sectional configuration so that as the tool is rotatably driven inwardly of the tube, the beading roll rotatably engages and deforms the end portions of the tube against the plate, thereby forming, at the end of the tube, a tight, generally arcuate-shaped beaded seal about the rim of the opening.

The tool also includes means to limit the axial displacement of the mandrel into the housing and tube. In the preferred embodiments this limiting means is in the form of a stop nut mounted on the mandrel. The stop nut is threaded onto the end portion of the mandrel extending beyond the end of the housing opposite the cage-end at a position therealong such that it will engage the housing and prevent further forward movement of the mandrel once the tube has been expanded to the desired diameter. In such an arrangement, the beading roll or rolls and the associated support rollers may advantageously be positioned on the housing at a location such that the beading roll engages the end of the tube before the tube has been expanded to the desired diameter so that the maximum force of the inwardly advancing tool is used to form the bead. Because of the magnitude of the beading forces and the radial separation of these forces from the center line of the apparatus, it is necessary to provide means to offset the resulting bending moments thus provided. To accomplish this end, a bearing race is mounted on roller bearings at the forward end of the housing and positioned to engage and roll along the inner surface of the tube or workpiece. In this manner, reaction force moments are generated to maintain the net bending forces on the housing in balanced equilibrium.

In a second embodiment, the strap extending across the support rollers is eliminated and substituted by a spring clip adapted to retain the beading roll onto the housing and in engagement with the support rollers.

Alternately, two beading rolls may be used to form the bead with each of the rolls and the associated supporting rollers disposed symmetrically on opposite sides of the housing in order to balance the bending forces produced during the bead forming operation. This symmetrically disposition eliminates the requirement to offset the bending moments on the housing thereby obviating the need for a bearing race at the forward end of the housing.

The extremely high level of efficiency of the inventive apparatus has been formed to produce the forces which are required to cold work a boiler tube with the production of a minimum noise level and this feature provides a particular advantage in complying with regulations relating to minimum industrial noise levels as monitored by the Occupational Safety and Health Administration (OSHA).

DETAILED DESCRIPTION OF THE PREFERRED EMBODIMENTS

Figure 1:
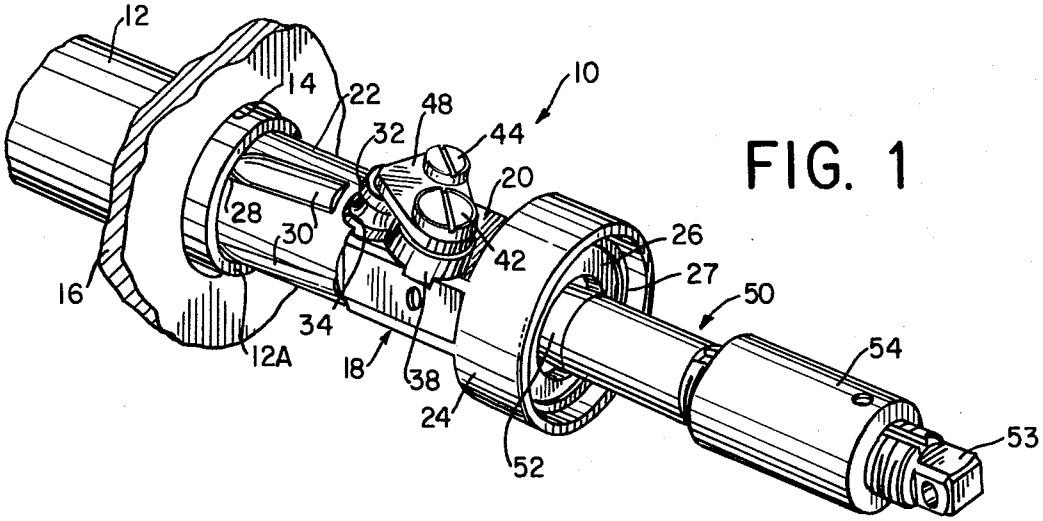
FIG. 1 is a perspective view of the apparatus of the present invention positioned for insertion into a tube for expanding and beading the end portion of the tube.
Figure 2:
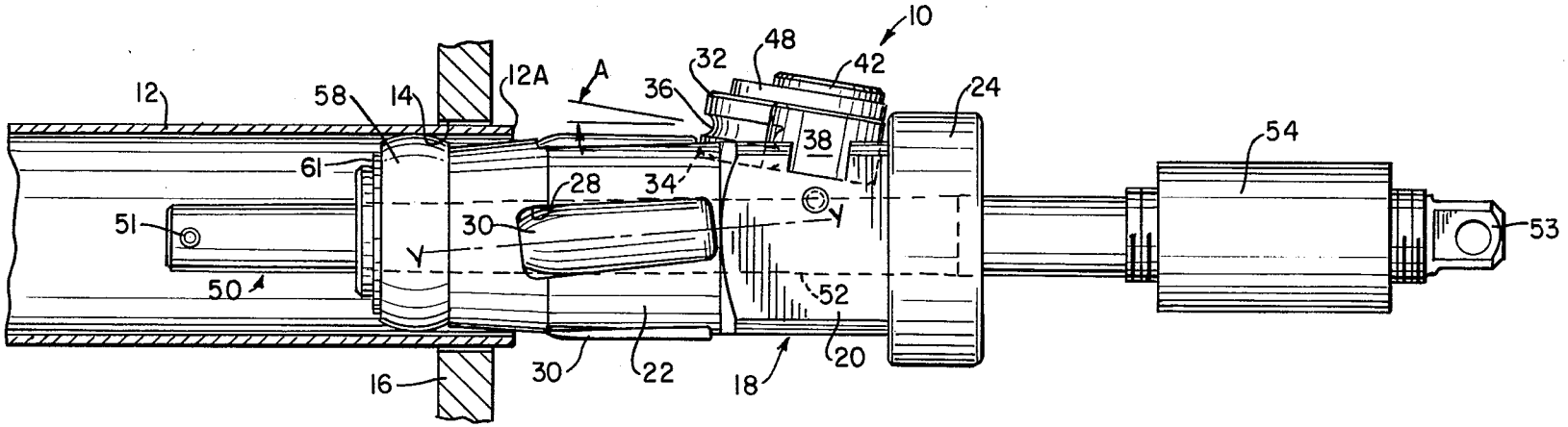
FIG. 2 is a side elevational view, partially in cross-section, of the apparatus of FIG. 1.

Referring to the drawings, FIGS. 1–8 illustrate the preferred combination expanding and beading tool 10 used to expand a steel boiler tube 12 into engagement with the walls of an opening 14 of a metal plate 16 and to form a bead about the rim of the opening. In FIGS. 1 and 2, the expanding and beading tool 10 includes a housing 18 having a central portion 20 of generally square cross-section and terminating in a circular housing 24 in which thrust bearing 26 is retained by snap ring 27. The forward portion of the housing defines a cage 22 having a cylindrical exterior surface of a diameter less than the inside diameter of the tube 12 and provided with a plurality of slits 28 about the periphery thereof. Tube expanding rollers 30 are fabricated of tool hardened steel and are disposed for rotation within each slot.

Figure 3:
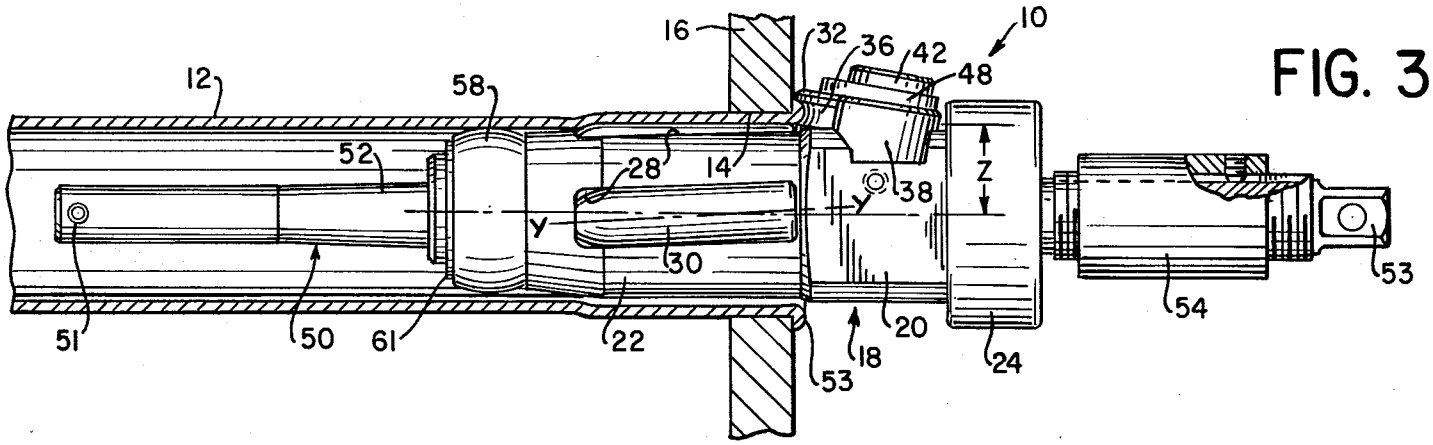
FIG. 3 is a side elevational view, partially in cross-section, of the apparatus of FIG. 1 illustrating the expanding and beading process.

Referring now to FIG. 3, it will be seen that the slots 28 and rollers 30 are offset at an acute angle relative to the longitudinal axis of the housing as illustrated by axis Y—Y. The rollers 30 are conical and taper from the forward end toward the rear end of the housing. The rollers 30 are retained in the cage 22 by peening over the outer edges of the slots as shown in detail in FIG. 6. Thus, the rollers are free to rotate and to move in a generally radial direction within the slots 28.

Figure 8:
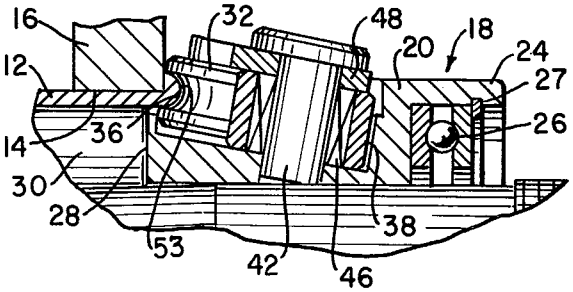
FIG. 8 is a view, partially in cross-section, taken along lines 8—8 of FIG. 4.

Referring now to FIGS. 2 and 3 in conjunction with FIG. 1, there is shown a beading roll 32 mounted for rotation in a pocket 34 on the housing 18. The beading roll 32 has a concave peripheral groove 36 for reception of an end portion 12A of the tube 12 which is positioned for expansion and beading by the apparatus. The beading roll 32 is constructed of through hardened steel and has a minimum diameter to facilitate concentration of the substantial bead forming forces which are required to cold work the end portion of the tube 12. To provide reaction forces sufficient to support the substantial beading forces, support rollers 38 and 40 are rotatably mounted on housing 18 by retaining pins 42 and 44, respectively, about bearings 46 as shown in FIG. 8 for example, with respect to roller 38. The bearings 46 mounting support rollers 38 and 40 are preferably in the form of needle bearings as shown in FIG. 8 and are capable of supporting substantial radial forces.

Referring to FIG. 2, the beading roll 32 is retained in pocket 34 by a retaining strap 48 which extends over rollers 38 and 40 and is secured in position by the respective retaining pins 42 and 44. The beading roll 32 is preferably tilted at an acute angle "A" as shown in FIG. 2. This offset angle, combined with a limited degree of movement in the vertical direction, provides a unique positioning advantage in ultimately facilitating alignment of the concave groove 36 of the beading roll 32 with the portion of the tube 12 to cold form a bead on the end of the tube.

A tapered mandrel 50 is positioned within the housing 18 as shown in FIGS. 1, 2 and 3, and is free to rotate and to move axially relative to the housing 18 while the housing and mandrel assembly are rotatably driven inwardly of the tube 12. The mandrel 50 has a tapered conical exterior surface 52 over a portion of its length which is in contact with the rollers 30 and a square drive end 53. This portion of the mandrel tapers gradually toward its forward end in a direction opposite the taper of the rollers 30 wherein it is retained in the housing by a roll pin 51. In use, the mandrel 50 is initially disposed axially of the housing 18 as shown in FIG. 1. As the mandrel 50 is rotated and directed inwardly of the housing 18, the housing and mandrel assembly rotate into the tube 12 and the diameter of the portion of the mandrel 50 which is in engagement with the rollers 30 at any given instant of time continuously increases, thereby forcing the rollers 30 to move generally outwardly in their respective slots 28 to expand the end portion of tube 12. The stop nut 54 is selectively adjustably locked in position lengthwise of the mandrel 50 and prevents further movement of the mandrel into the housing 18 by engagement with thrust bearing 26.

Referring now to FIG. 3, there is illustrated a support race 58 mounted on the forward end of the housing 18 for rotatably engaging the inner surface of the tube 12 to provide resisting forces which counteract bending moments provided by the bending forces of beading roll 32 during the beading process. These bending forces are caused by the radial separation "Z" between the actual line of force of the beading roll 32 and the central axis of the housing as shown in FIG. 3. The support race 58 is supported on a high load needle bearing 60 as shown schematically in FIG. 5, and this bearing is maintained in position by snap ring 61.

In operation, the tube 12 is positioned within the tube sheet 14 as shown in FIG. 1 with an appropriate end portion 12A extending outwardly of the sheet. The tool is then inserted into the tube 12 until the rollers engage the tube and further manual entry is prevented. Depending upon circumstances, the beading roll 38 is either close to, or in actual engagement with, the end portion 12A of the tube at the start of the operation. The mandrel is then advanced into the housing 18 until the surface of the tapered portion thereof engages the rolling surfaces of the rollers 30 and further movement is prevented. Thereafter, the mandrel is simultaneously rotated and advanced into the housing by a suitable hand or power tool such as a wrench or a rotatably driven chuck or socket which is suitably positioned about the square drive end 53. As the mandrel 50 is rotated and directed into the housing the increasing engagement of the tapered portion 52 with the tapered rollers 30 forces the rollers 30 outwardly into progressive increasing engagement with tube 12. The tilted orientation of rollers 30 causes them to traverse a generally helical path when they enter the tube 12 and thereby move forwardly while simultaneously expanding the end portion of the tube. Advantageously, the feed angle of the expander rollers 30 is kept as low as possible in order to assure a positive feed action and this action provides a substantial mechanical advantage somewhat analogous to the movement of a screw with a fine pitch thread.

Figure 4:
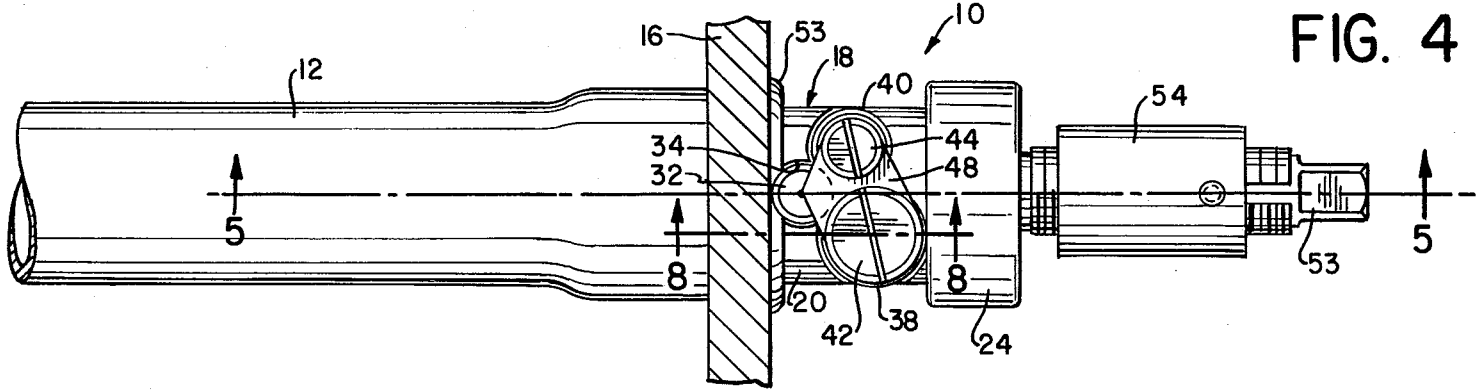
FIG. 4 is a plan view of the apparatus shown in FIG. 3.
Figure 5:
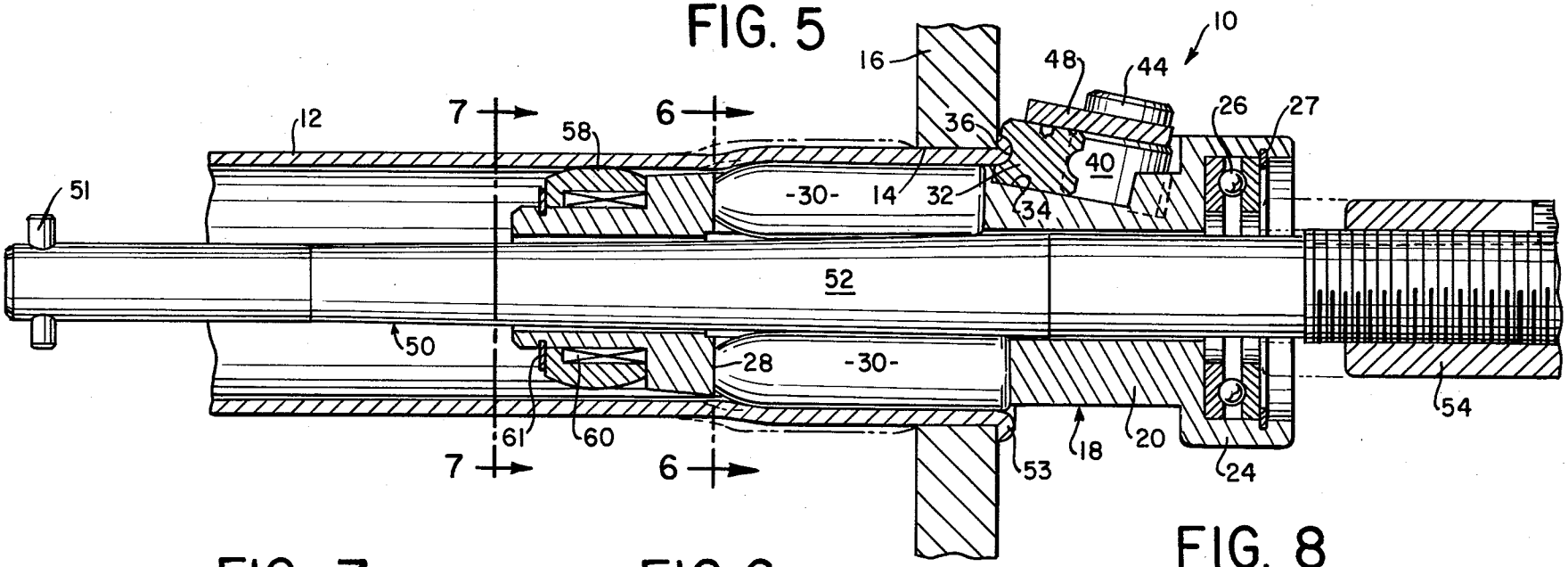
FIG. 5 is a cross-sectional view taken along lines 5—5 of FIG. 4.

In the present arrangement, when the beading roll is in contact with the end portion 12A of the tube 12, the entire force of the roll is available to form a bead on the tube end. However, the entire force available is not always of sufficient magnitude to perform the required operation. This force is at a minimum level initially while the tube expanding rollers 30 are expanding the tube 12 to a condition in which the outer diameter of the tube 12 actually contacts the surface of the opening 14. At this point the force increases relatively quickly reaching the maximum level which is necessary to deform the end of the tube. These inward traction forces caused by the offset rollers 30 are translated into cold working forces applied by the beading roll 32 to the end portion 12A of the tube 12 and are sufficient to deform the end portion of the tube and to form a bead 53 as shown in FIGS. 3, 4, and 5. The relatively small size of the beading roll 32 renders it capable of translating substantial traction forces into a single concentrated force vector acting at the point of engagement with the tube end 12A. This force vector is maintained by the reaction forces between the beading roll 32 and support rollers 38 and 40, and the bending forces are maintained in equilibrium by the rolling engagement between the support race 58 and the inner surface of tube 12.

Before the expansion rollers 30 have fully expanded the end portion of the tube 12, the beading roll 32 will have fully deformed the exposed end portion 12A of the tube 12 and the result will be the creation of a water-tight bead about the periphery of the opening of the boiler plate 16 as shown in FIGS. 3, 4, 5 and 8. This metal-to-metal, beaded condition will be complete at approximately the same point of time in which the stop nut 54 engages the thrust bearing 26 and thereafter, further advancement of the mandrel 50 is prevented.

Depending upon circumstances, the beading roll 32 may be positioned close to, or in engagement with, the end portion 12A of tube 12. The precise relation is determined by several factors. One factor is the clearance between the tube sheet opening 14 and the outer diameter of the tube 12. The greater this clearance, the further back the beading roll could be set since effective tractive effort is not actually developed until the tube 12 is expanded to a metal-to-metal condition. A second factor is the effective length of the expanding rolls. In a preferred embodiment, the expanding rolls 30 are approximately $1\frac{1}{2}$ inches in effective length while tube sheet thicknesses will generally extend from three-eighths to seven-eighths inch, with seven-sixteenths to nine-sixteenths inch being most common. Since in use with thinner tube sheets excessive expansion rolling is often sought to be avoided, the effective length of the expansion rolls 30 are preferably maintained at minimum levels.

Even though the clearance between the tube 12 and the tube sheet 16 permits setting the beading roll 32 somewhat away from the tube end, the relatively short effective length of the roll 30 would preclude this approach. It has therefore been found that the preferred operative technique to follow is to commence the expansion and beading process by setting the apparatus with the beading roll 32 close to, or actually in contact with, the tube end 12A. The circumstances and conditions prevailing will determine the limits as to the precise permissible initial distance between the tube end 12A and the beading roll 32 consistent with the creation of a satisfactory connection.

It can be seen that in the arrangement of FIG. 1 substantial forces are transmitted from the housing 18 to the beading roll 32 via the support rollers 38 and 40. These forces are, in turn, maintained in equilibrium by the rolling engagement between support race 58 and the inner surface of the tube when counteracting bending moments are provided in response to the bending moments created by the radial separation between beading roll 32 and the axis of the apparatus. These features contribute toward the development of balanced forces and the creation of purely longitudinal cold working forces which uniquely provide the expansion and bead formation necessary to form a seal which is impermeable to such elements as steam, hot water, fire, etc. It is appropriate to note that the relatively small size and portability of the apparatus of FIG. 1 makes it possible to transport it directly to the workpiece where the expansion and beading operation may be performed even where a limited space is available.

Figure 6:
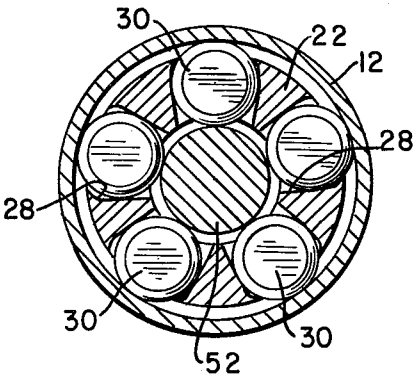
FIG. 6 is a view, partially in cross-section, taken along lines 6—6 of FIG. 5.
Figure 7:
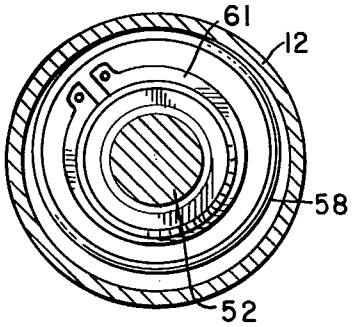
FIG. 7 is a view, partially in cross-section, taken along lines 7—7 of FIG. 5.
Figure 9:
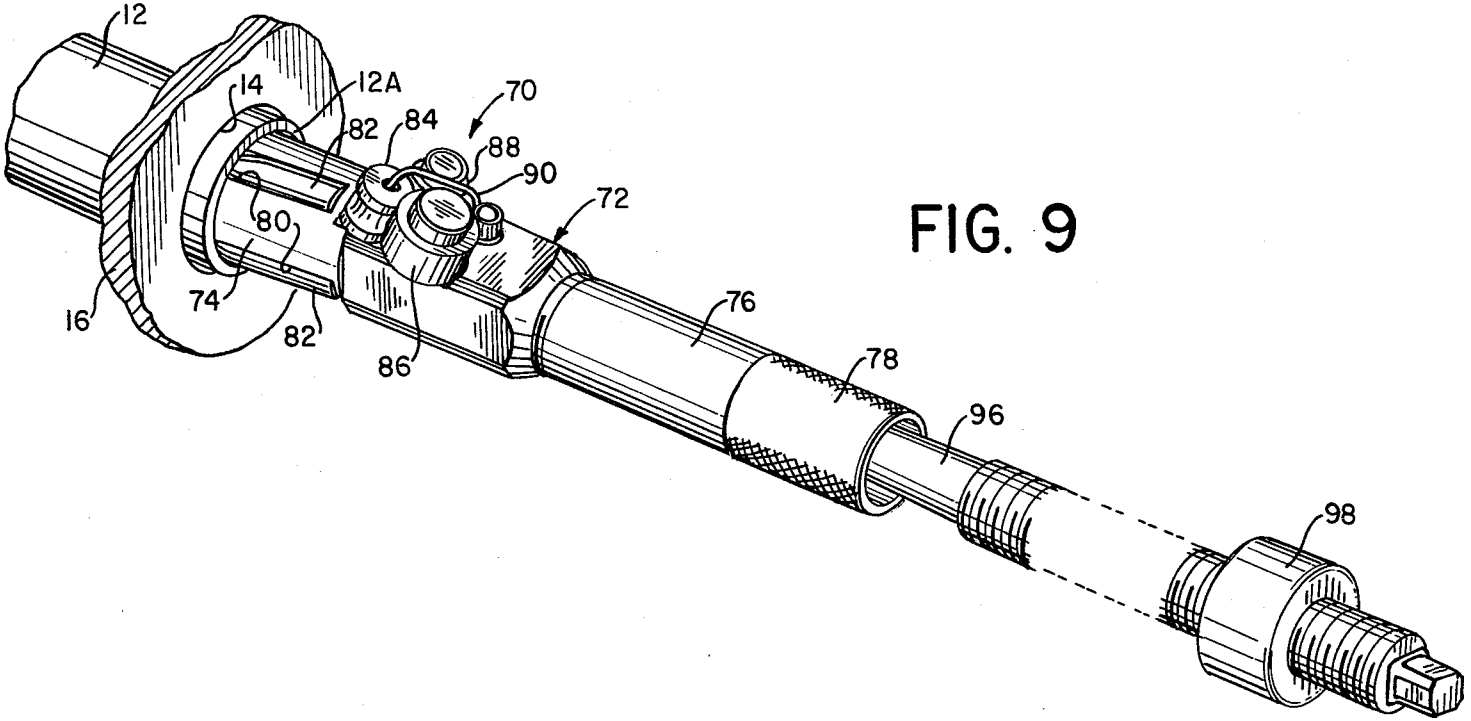
FIG. 9 is a perspective view of an alternate embodiment of the invention.
Figure 10:
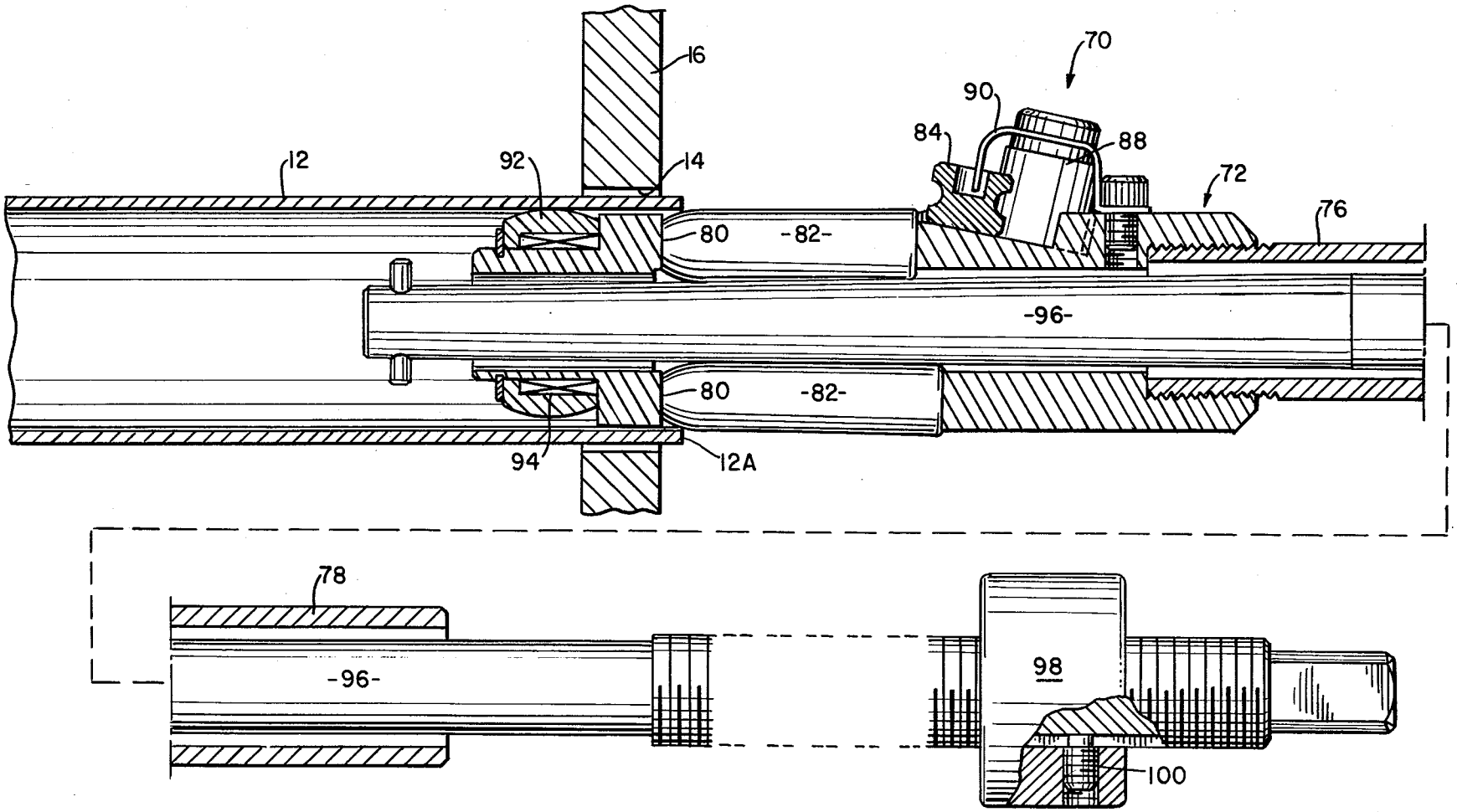
FIG. 10 is an enlarged side elevational view, partially in cross-section, of the apparatus of FIG. 9 positioned for insertion into a tube which is to be expanded.

FIGS. 9 and 10 illustrate an alternate embodiment of the invention of FIGS. 1–8. An expanding and beading apparatus 70 includes a housing 72 having a central portion of square cross-section, a forward cage 74, and a hollow cylindrical shank 76 at a rear end having a knurled outer gripping portion 78 as shown. The cage 74 has a cylindrical exterior surface of a diameter less than the inside diameter of the tube 12 and is provided with a plurality of generally axial slots 80 about its periphery thereof with tapered rollers 82 disposed in each slot, similarly to the embodiment of FIG. 1. The slots 80 and rollers 82 are offset at an acute angle relative to the longitudinal axis of the housing in the same manner as the embodiment of FIG. 1. These rollers are tapered and retained within the housing by the outer edge portions of the housing defining the slots 80 as illustrated in FIG. 6 with respect to the first embodiment. A beading roll 84 is supported in the axial direction by support rollers 86 and 88 and this beading roll is retained in position in a vertical direction by spring clip 90.

As shown in FIG. 10, a support race arrangement 92 is positioned about roller bearings 94 in order to provide engagement bending moments between the housing and the workpiece (tube 12) to facilitate an arrangement of balanced bending moments with a net axial cold working force acting between the beading roll 84 and the end portion 12A of tube 12. Tapered mandrel 96 is positioned within housing 72 as shown in FIGS. 9 and 10. This mandrel 96 is operatively rotatably advanced into the housing to develop expanding and beading forces as described in connection with FIG. 1. With the proper selection of tube sheet 16, hole diameter 14, tube 12 position with projecting portion 12A, the expansion and beading process will be substantially completed when stop nut 98 engages the knurled shank 76 in the same manner as the engagement of stop nut 54 and bearing 26 in connection with the apparatus of FIG. 1. For convenience, stop nut 98 is locked in position along mandrel 96 by set screw 100 shown in FIG. 10. A bearing (not shown) is positioned in the forward portion of the stop nut to facilitate continued rotation of the mandrel upon engagement with the shank 76.

Referring now to FIGS. 11–14, there is illustrated an alternate combination expanding and beading tool 110 for expanding a metal tube 12 into engagement with the walls of an opening 14 of a metal plate 16 and to form a bead about the rim of the opening. The expanding and beading tool 110 includes a housing 112 having a central portion 114 of square cross-section, with a cage 116 at one end and a hollow cylindrical knurled shank 118 at the other end. The cage 116 has a cylindrical exterior surface of a diameter less than the inside diameter of the tube 12 and is provided with a plurality of generally axial slots 120 about the periphery thereof with tapered rollers 122 disposed in each slot in the same manner as the rollers of the previous embodiments. The slots 120 and the rollers 122 are offset at an acute angle relative to the longitudinal axis of the housing as illustrated by axis X—X in FIG. 11. The rollers 122 are free to rotate and to move within the slots 120 in a radial direction and are retained in the cage 116 by peening over the outer edges of the slots 120 in the same manner as in the previous embodiments.

A mandrel 124 is positioned generally coaxially with the central longitudinal axis of the housing 112 and is free to rotate and move axially relative to the housing as in the first embodiments. The mandrel 124 has a tapered conical exterior surface 126 which tapers opposite the taper of the rollers 122 toward its leading end as shown particularly in FIGS. 11 and 12. The diameter of the mandrel 124 in engagement with the rollers 122 continuously increasingly forces the rollers 122 to move outwardly in the slots 120 when the mandrel 124 is rotatably shifted into the housing in the same manner as described above with respect to the embodiment of FIGS. 1–8. Moreover, since the rollers 122 are in engagement with the mandrel, rotation of the mandrel causes the rollers 122 to rotate about their respective axes in the slots 120. The portion of the mandrel 128 extending through and beyond the shank 118 is threaded for reception of stop nut 130. The stop nut 130, which houses a roller bearing (not shown) is selectively locked in one of several positions lengthwise of the mandrel by means of a set screw 132 which engages an axial groove 134 formed in the mandrel.

As the mandrel is rotated and displaced into the cage end of the housing 112, the rollers 122 traverse a helical path into the tube 12 simultaneously drawing the mandrel forward until the thrust bearing mounted in stop nut 130 engages the end of shank 118 preventing further forward travel of the mandrel. The position of the stop nut 130 along the threaded portion of the mandrel therefore determines the extent of the outward movement of the rollers 122 in slots 120 by limiting the forward movement of the mandrel 124 in housing 112. The shank 118 provides space for the threaded portion 128 of the mandrel 124 so that the threads do not contact the inner surface portions of the shank 118. A pin 136 extends through the forward end of the mandrel 124 to retain it in the housing 112. The rear end portion of the mandrel terminates in a square or other suitable drive end by means of which it can be rotated by a wrench, power tool or the like as in the embodiments of FIGS. 1 and 9.

Figures 11, 12, 13, 14, 15:
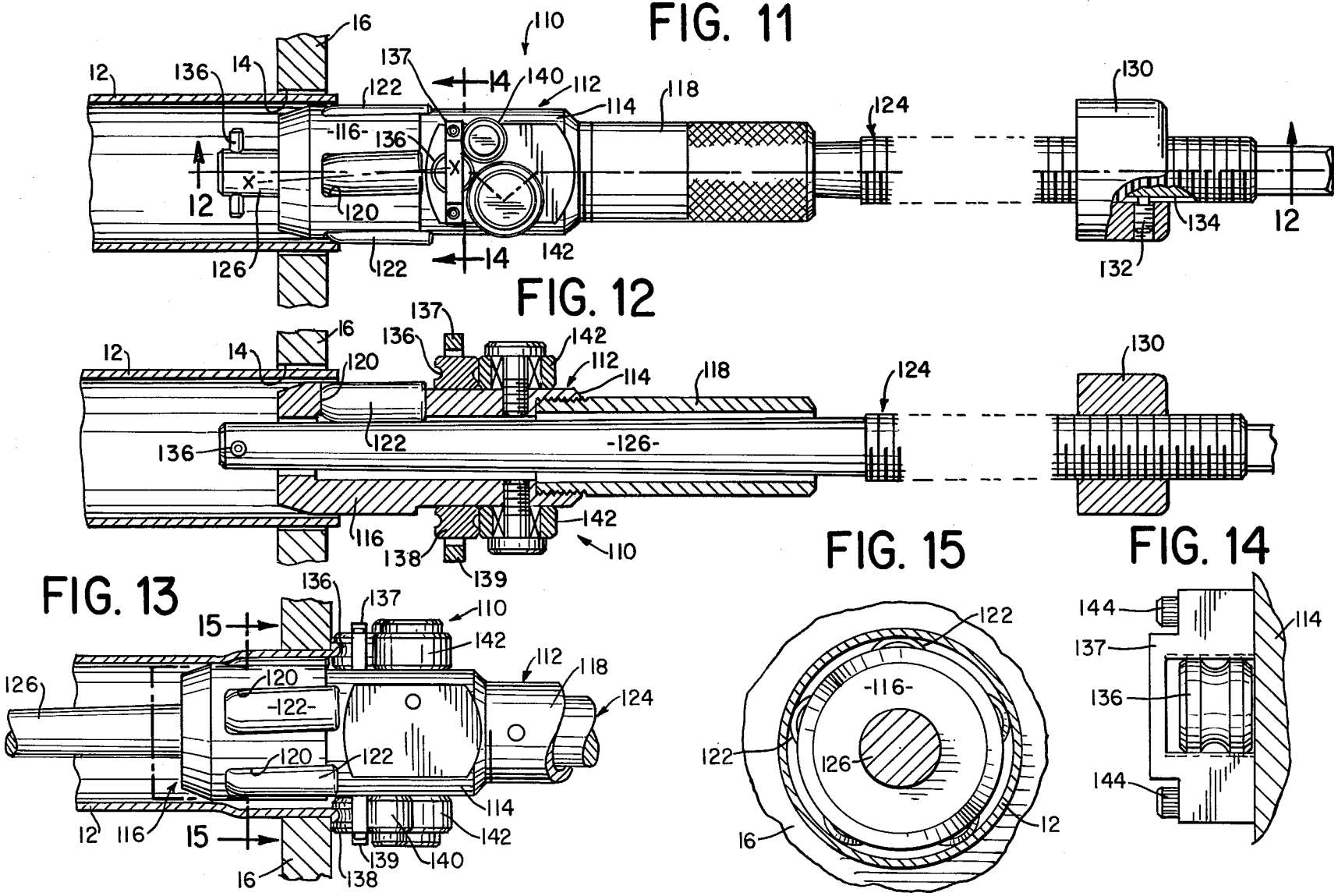
FIG. 11 is a plan view of a second alternate embodiment of the inventive apparatus.
FIG. 12 is a cross-sectional view taken along lines 12—12 of FIG. 11.
FIG. 13 is a view, partially in cross-section, of the apparatus of FIG. 11, illustrating the expanding and beading process.
FIG. 14 is a view, partially in cross-section, taken along lines 14—14 of FIG. 11.
FIG. 15 is a view, partially in cross-section, taken along lines 15—15 of FIG. 13.

Disposed symmetrically on opposite sides of the central portion 114 of the housing 112 are beading rolls 136 and 138. Each beading roll is associated with a pair of support rollers 140 and 142 rotatably mounted on roller bearings affixed to a central shaft mounted on the housing 112 as shown in FIGS. 11 and 12. Each pair of supporting rolls 140 and 142 form a pocket in which is seated a through hardened beading roll 136 and 138 respectively, on each side of the housing. Each beading roll has a concave groove about its periphery as shown in FIG. 12 and in connection with the embodiment of FIG. 1. Each of the beading rolls 136 and 138 is retained on the housing by an associated strap 137 and 139, respectively, which is secured to the housing 112 by screws 144. The straps 137 and 139 are positioned above and below the housing as shown and permit the beading rolls to shift vertically a small distance in a direction perpendicular to the axis of rotation of the housing.

The operation of the apparatus is similar to the operation of the preferred embodiments previously described, with the exception that the beading process is accomplished by dual beading rolls 136 and 138 rather than a single beading roll. This distinction provides less concentration of beading forces than that of the embodiments described previously; however, the beading forces nevertheless have been found to be sufficient to form a satisfactory peripheral bead. To expand and bead the portion of tube 12 extending through an opening 14 in plate 16, the stop nut 130 is locked in position along mandrel 124 at a location determined by the extent to which tube 12 is to be expanded. Because of the symmetrical positioning of the beading rolls 136 and 138, the necessity for a support race to offset bending moments created by the beading operation is obviated in connection with this embodiment.

To maximize the traction forces generated by the expansion rollers in either of the embodiments described, the angle at which the rollers are inclined from the central axis of the housing is minimized and the number of expansion rollers and their diameters are kept at a maximum, compatible with the cage size and strength requirements which are dictated by the diameter and thickness of the tubes to be expanded.

Furthermore, with respect to any of the embodiments described, maximum traction forces may be developed on the housing by the application of a suitable degreasing solvent on the inside surfaces of the tube to be expanded on the surfaces of the rollers so as to degrease the contacting surfaces prior to the expansion of the tube. A suitable solvent which may be used would preferably be non-explosive and would have a high flash point while being non-toxic and having a relatively low lubricity. Such solvents may provide the appropriate degreasing qualities where traction forces are being developed while at the same time they will, in fact, provide certain lubricating qualities at critical contact points, as between the expanding rollers and the cage, for example. In addition, the application of a suitable solvent has been found to assist in the dissipation of heat generated by the metal cold working forces.

I claim:

1. An apparatus for expanding and beading an end portion of a metal member positioned within an opening defined by an outer member, which comprises a housing having one end portion adapted to be inserted into one end portion of the tubular member, means mounted on said housing for expanding at least a part of the end portion of the tubular member outwardly into engaged relation with peripheral portions of the opening and for developing traction forces directed axially into the tubular member, means to engage and deform the end portion of said tubular member in its cold condition so as to form a generally arcuately configured peripheral bead thereabout when the housing is drawn inwardly of the tubular member by said inwardly directed forces, rotatably mounted means for rotatably engaging and supporting said beading means in a direction generally axial of the housing and the tubular member and for transmitting reaction forces to said beading means sufficient to cause said beading means to deform the end portion of the tubular member by cold working the end portion when the housing is drawn therein.

2. An apparatus for expanding and beading an end portion of a metal tubular member positioned within an opening defined by an outer member which comprises a generally elongated housing having one end portion adapted to be inserted into one end portion of the tubular member, means mounted on said housing for expanding at least a part of the end portion of the tubular member outwardly into engagement with peripheral portions of the opening and for developing traction forces directed generally axially inward of the tubular member, means rotatably mounted on said housing to engage and deform the end portion of said tubular member in its cold condition so as to form a generally arcuately configured peripheral bead thereabout when the housing is drawn inwardly of the tubular member by said inward traction forces, rotatably mounted means for rotatably engaging and supporting said beading means in a generally axial direction and for transmitting reaction forces to said beading means sufficiently concentrated to cause said beading means to deform the end portion of the tubular member by cold working the end portion when the housing is drawn therein by said traction forces, said beading means and traction forces providing beading forces sufficiently concentrated to deform the end portion of the tubular member in ts cold condition.

3. An apparatus for expanding and beading an end portion of a metal tubular member comprising:

(a) an elongated housing having a peripheral wall portion which defines a plurality of generally elongated openings extending therethrough and positioned thereabout;

(b) rolling means mounted for rotation within each opening and dimensioned and oriented with respect to the central axis of the housing such that insertion of said housing into an end portion of the tubular member and rotating said housing in a manner to cause the rolling means to engage and roll along inner surface portions of the tubular member while simultaneously directing said rolling means radially outwardly in engagement with said inner wall portions of the tubular member, expands an end portion of the tubular member while progressively developing traction forces which direct the housing inwardly of the tubular member;

(c) an elongated tapered member positioned within the opening defined by said housing, said member being axially movable from a first position to at least a second position in engagement with portions of the rolling means facing the inner portion of the housing, and further rotational movement into the housing causes the rolling means to move outwardly further while in engagement with inner surface portions of the tubular member to develop said inward traction forces on said housing while expanding at least a part of the tubular member;

(d) means rotatably mounted on said housing for engaging the end of the tubular member and for transmitting said traction forces directly against the end portions of the tubular member to deform the end portion by cold working the metal material so as to form an arcuate bead on said tubular member; and (e) means rotatably mounted on said housing in adjacent engaged rotatable relation with said rotatable tube deforming means to provide generally axial reaction forces to support said rotatable deforming means in providing forces sufficient to deform said tubular member while said rolling means progressively expands the end portion of said tubular member.

4. The apparatus according to claim 3 wherein one end portion of said housing defines a plurality of slots about the periphery and said rolling means comprises at least one roller rotatably mounted within each slot.

5. The apparatus according to claim 4 wherein the rotational axis of each roller is positioned at a generally acute angle in relation to the central axis of said housing, the orientation of said rollers being such that rotating said housing in a first direction within the tubular member causes the rollers to engageably expand the end portion of the member while developing inward traction forces on said housing.

6. The apparatus according to claim 5 further comprising an elongated tapered mandrel disposed within said housing with the taper being directed such that axial movement of said mandrel into said housing results in engagement of the tapered surface portions thereof with said rollers and that progressive inward rotational movement of the mandrel into the housing causes the rolling means to move generally radially outward of the housing so as to provide expansion forces outwardly against the inner surface portions of the tubular member.

7. The apparatus according to claim 6 wherein each of said rollers has a generally tapered configuration generally opposite the taper of said mandrel such that upon rotatably engaging said rollers with inner surface portions of said tubular member causes said rollers to traverse a helical path and produce traction forces between said tubular member and said housing in a direction inward of said tubular member.

8. The apparatus according to claim 7 further comprising means for limiting the axial movement of said mandrel into said housing.

9. The apparatus according to claim 8 wherein said limiting means comprises a stop nut adjustably positioned on a portion of said mandrel extending beyond the end of said housing opposite said end portion thereof which engages said housing and prevents further axial movement of said mandrel when said mandrel is displaced a predetermined distance into said housing.

10. The apparatus according to claim 9 wherein said beading means comprises at least one beading roller rotatably mounted on said housing and defining a generally concave groove about the periphery thereof, said groove being configured to receive the end portion of said tube for deforming said end portion to form a generally arcuate bead thereabout.

11. The apparatus according to claim 10 wherein said beading means comprises at least one beading roller mounted for rotation on said housing and at least two support rollers in engaged rotational relation therewith for supporting said beading roller against forces sufficient to deform the end portions of said tubular member.

12. The apparatus according to claim 11 wherein said support rollers are rotatably disposed about rotational needle bearing means mounted on said housing and means is provided to support said rollers in position on said housing.

13. The apparatus according to claim 12 further comprising bearing means disposed about the inner end portion of said housing for rotational engagement with inner surface portions of said tubular member to provide bending forces generally opposite the bending forces provided by said beading means when the end protion of said tubular member is being deformed.

14. The apparatus according to claim 11 wherein said beading means comprises at least two beading rollers, each roller positioned at generally opposed positions on said housing, each beading roller defining a generally concave groove for engagement with end portions of said tubular member to form a peripheral bead thereabout, said beading rollers being mounted for rotation on said housing, the bending forces provided by each roller counteracting the beading forces provided by the other roller.

15. The apparatus according to claim 14 further comprising at least two support rollers mounted for rotational engagement with each beading roller, each support roller being disposed about bearing means such that said support rollers are capable of providing reaction forces which support said beading rollers against the beading forces exerted on the end portions of said tubular member.

16. An apparatus for expanding and beading an end portion of a metal tubular member positioned within a generally circular opening defined by a tube sheet which comprises an elongated housing having at one end portion, a cage defining a plurality of slotted portions thereabout, said cage being adapted for insertion into an end portion of the tubular member, generally tapered rolling member positioned for rotation and outward radial movement with each slotted portion of said cage, said rolling members being oriented at a generally acute angle relative to the central axis of the housing, a generally tapered mandrel positioned within said housing, the taper of the mandrel being generally opposite the taper of each rolling member such that positioning said housing within an end portion of said tubular member and progressively rotatably advancing said mandrel into engaged relation with the rolling members causes the rolling members to move radially outwardly against inner surface portions of said tubular member to provide expansion forces thereon and to cause the expanded portion of said tubular member to become engageably seated within the opening defined by said tube sheet, at least one beading roll mounted for rotation on said housing and defining a generally concave peripheral groove, at least two support rollers rotatably mounted for rotatably engaging and supporting said beading roll in a generally axial direction and for transmitting reaction forces to said beading roll sufficiently concentrated to cause said beading roll to deform the end portion of the tubular member by cold working the metal material, means extending across said support rollers and positioned above said beading roll to retain said beading roll on said housing and to support said rollers against generally axial forces provided by said beading roll, the rotational axis of said beading roll being oriented at a generally acute angle relative to a plane perpendicular to the central axis of the housing and at a location such that advancing said mandrel and said housing into said tubular member develops traction forces between said rolling members and said tubular member, said beading roll being positioned such that movement of said housing a predetermined distance within said tubular member causes the free end portion of said tubular member to be engageably received by said beading roll as said beading roll rotates thereabout, said traction forces being sufficient to cause the beading roll to deform the end portion of said tubular member to form an arcuately configured bead thereabout, generally arcuate bearing means disposed about the inner end portion of said housing with the axis of rotation of said bearing means being displaced from the rotary axis of said housing such that outer surface portions of said bearing means rotatably engage inner surface portions of said tubular member when said mandrel and said housing are rotatably advanced therein so as to provide force moments generally opposite the force moments provided by said beading roll when said end portion of said tubular member is deformed in its cold condition.

17. An apparatus for expanding and beading an end portion of a metal tubular member positioned within a generally circular opening defined by a tube sheet which comprises an elongated housing having at one end portion, a generally tubular cage defining a plurality of slotted portions thereabout, said cage being adapted for insertion into an end portion of the tubular member, a plurality of generally tapered rolling members positioned for rotation and outward radial movement within said slotted portions of said cage and oriented at a generally acute angle relative to the central axis of the housing, a generally tapered mandrel positioned within said housing with the taper of the mandrel being generally opposite the taper of each rolling member such that positioning said housing within an end portion of said tubular member and rotatably advancing said mandrel into engaged relation with the rolling members causes the rolling members to move radially outwardly against inner surface portions of said tubular member to provide expansion forces thereon and to cause the expanded portion of said tubular member to become engageably seated within the opening defined by said tube sheet, at least one beading roll mounted for rotation on said housing and defining a generally concave peripheral groove, at least two support rollers rotatably mounted for rotatably engaging and supporting said beading roll in a generally axial direction and for providing support forces to said beading roll sufficiently concentrated to permit said beading roll to deform the end portion of the tubular member by cold working the metal material, means to retain said beading roll on said housing, the axis of said beading roll being oriented at a generally acute angle relative to a plane perpendicular to the central axis of the housing and at a location such that advancing said mandrel and said housing into said tubular member develops traction forces between said rolling members and said tubular member, said beading roll being positioned such that movement of said housing a predetermined distance within said tubular member causes the free end portion of said tubular member to be engageably received by said beading roll as said beading roll rotates thereabout, said traction forces being sufficient to cause the beading roll to deform the end portion of said tubular member in its cold condition to form an arcuately configured bead thereabout, generally rotatable bearing means disposed about the inner end portion of said housing with the rotary axis of said housing such that outer surface portions of said bearing means rotatably engage inner surface portions of said tubular member when said mandrel and said housing are rotatably advanced therein so as to provide force moments generally opposite the force moments provided by said beading roll when said end portion of said tubular member is deformed in its cold condition.

18. An apparatus for expanding and beading an end portion of a tube positioned within a generally circular opening defined by a tube sheet which comprises an elongated housing having at one end portion, a generally tubular cage defining a plurality of slotted portions thereabout, and at the other end portion a generally elongated cylindrical portion having a central opening therethrough and a knurled outer surface portion for manually gripping, said cage being adapted for insertion into an end portion of the tube, a plurality of generally tapered rollers mounted for rotation and outward radial movement within said slotted portions of said cage, said tapered rollers being oriented at a generally acute angle relative to a plane passing through the central axis of the housing, a generally tapered mandrel positioned within said housing with the taper of the mandrel being generally opposite the taper of each roller such that positioning said housing within an end portion of said tube and rotatably advancing said mandrel into engaged relation with said rollers causes said rollers to move radially outwardly against inner surface portions of said tube while providing expansion forces thereto which expand the end portion of said tubular member into engaged seated relation within the opening of said tube sheet, a beading roll mounted for rotation on each of two opposed side portions of said housing, each beading roll defining a generally concave endless peripheral groove thereabout, at least two support rollers rotatably mounted on bearing members on said housing for engaging and supporting each beading roll in a generally axial direction and for providing support forces to said beading rolls sufficiently concentrated to permit said beading rolls to deform the end portion of the tubular member by cold working the metal material, each beading roll being positioned on said housing at a location and orientation such that progressively rotatably advancing said mandrel and said housing with said housing and roller cage positioned within the tube causes said expansion rollers to move outwardly into engaged rotational relation with inner surface portions of the end portion of said tube to provide expansion forces thereto and inward traction forces on said housing, and causes each beading roll to receive the end portion of said tube within the peripheral groove, and said traction forces are transmitted through said housing to said beading rolls to deform the end portion of said tubular member in its cold condition to form an arcuately configured bead thereabout in substantially sealed abutting relation with said tube sheet, while the reaction forces provided by said support rollers on said beading rolls are maintained at sufficient levels to withstand the deformation forces applied to said tube, means mounted on said mandrel to engage the shank portion of said housing to prevent further advancement of said mandrel and said housing into said tube when the end portion of said tube is expanded and beaded to a predetermined degree.

* * * * *

UNITED STATES PATENT AND TRADEMARK OFFICE

CERTIFICATE OF CORRECTION

PATENT NO. : 4,090,382
DATED : May 23, 1978
INVENTOR(S) : Donald E. Schott

It is certified that error appears in the above-identified patent and that said Letters Patent are hereby corrected as shown below:

Column 1, line 35, "for forming the" should read -- for forming tube --

Column 2, line 65, "which is positioned centrically" should read -- which is positioned centrally -

Column 3, lines 58-59, "The beading roll, moveover," should read -- The beading roll, moreover, --

Column 6, lines 18-19, "move generally outwardly" should read -- move generally radially outwardly --

Column 13, line 2, (Claim 13, line 7) "protion of said" should read -- portion of said --

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*